United States Patent [19]

Perra, Jr. et al.

[11] 4,314,503

[45] Feb. 9, 1982

[54] STENCIL PRINTING

[75] Inventors: Andrew G. Perra, Jr.; George H. Sparhawk, Jr., North Swanzey, both of N.H.

[73] Assignee: Markem Corporation, Keene, N.H.

[21] Appl. No.: 104,801

[22] Filed: Dec. 18, 1979

[51] Int. Cl.[3] ..... B41F 17/00

[52] U.S. Cl. ..... 101/41; 101/114; 101/127.1

[58] Field of Search ..... 101/35, 41, 114, 127.1

[56] References Cited

U.S. PATENT DOCUMENTS

| | | | |
|---|---|---|---|
| 594,322 | 11/1897 | Cabell | 101/114 |
| 635,060 | 10/1899 | Renner | 101/114 |
| 854,995 | 5/1907 | Faller | 101/114 |
| 1,170,932 | 2/1916 | Pritchard | 101/114 |
| 3,228,326 | 1/1966 | Childress | 101/114 |
| 3,299,804 | 1/1967 | Schueler | 101/35 |
| 3,389,654 | 6/1968 | Hirt | 101/35 |

FOREIGN PATENT DOCUMENTS

| | | | |
|---|---|---|---|
| 356364 | 9/1905 | France | 101/114 |
| 1148961 | 7/1957 | France | 101/114 |

OTHER PUBLICATIONS

Camuzat, IBM Tech. Disc. Bulletin, Vol. 6, No. 4, Sep. 1963, pp. 76,77.

*Primary Examiner*—Clyde I. Coughenour

[57] ABSTRACT

Stencil printing apparatus especially useful for printing on a curved or irregular underlying surface is described. It features a peripheral, elastically compressible and deformable stencil supporting wall and a flexible stencil screen having its outer peripheral edge sealingly mounted on the supporting wall, the stencil screen being deformable into continuous contact with the underlying surface with the supporting wall elastically compressed thereby for extrusion of printing fluid through the stencil screen onto the underlying surface to be printed.

2 Claims, 2 Drawing Figures

STENCIL PRINTING

Figure 1:
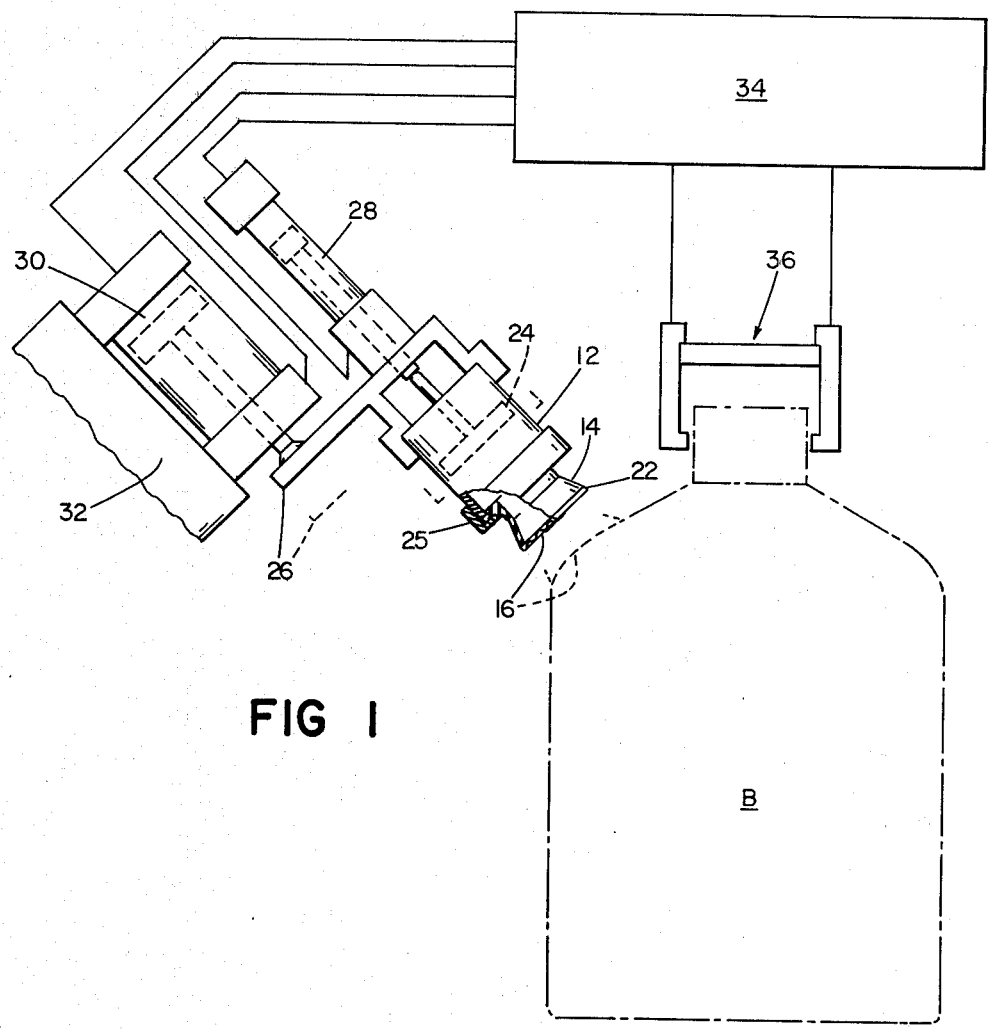

This invention relates to stencil printing apparatus, and more particularly to such apparatus capable of printing on a curved or irregular underlying surface.

In Tripp, U.S. Pat. No. 3,372,638, there is shown and described stencil printing apparatus especially useful for printing on plastic containers, such as those used in the dairy field and other segments of the food industry, consumer information such as the last date of sale. Although the apparatus disclosed in that patent has been successfully commercialized, its use is limited to printing the consumer codes on the vertical sides of the bottles. This has proved to be a disadvantage, since the printed codes cannot be viewed from above and so are frequently blocked from view when the bottles are stored in a dairy case.

Furthermore, the apparatus of that patent required the use of a vacuum source for holding the stencil against the surface to be printed and such a source was not always readily available and was also expensive.

It is a major object of the present invention to provide novel stencil printing apparatus capable of printing on a curved or irregular surface, particularly on the rounded shoulders of plastic bottles so that the code can be seen from above when the bottles are stacked in a conventional store diary case.

It is another object of the present invention to provide novel stencil printing apparatus which does not require a source of vacuum.

Accordingly, the present invention provides a novel stencil printing apparatus adapted for printing on a curved or irregular underlying surface, comprising a rigid member, elastically compressible and deformable supporting wall means mounted on one end of the rigid member and extending axially therebeyond, and a flexible stencil screen having its outer peripheral edge sealingly mounted on the outer edge of the supporting wall means and extending thereacross, the stencil screen being deformable into continuous contact with the underlying surface and with the supporting wall means being elastically compressed thereby for extrusion of printing fluid through the stencil screen onto the underlying surface to be printed.

In preferred embodiments of the present invention, the rigid member has side wall means providing a chamber for enclosing a quantity of printing fluid and the supporting wall means provides an axial extension of the chamber side wall means, the outer edge of the supporting wall means being normally generally perpendicular to the side wall means of the chamber, with the flexible stencil screen normally generally perpendicular to the side wall means of the chamber to form an end wall of the chamber. Preferably, piston means are mounted in the chamber adjacent the other end of the housing member for transmitting pressure to the printing fluid to extrude the printing fluid through the stencil screen onto the underlying surface when the stencil screen is in contact with the surface to be printed.

Figure 2:
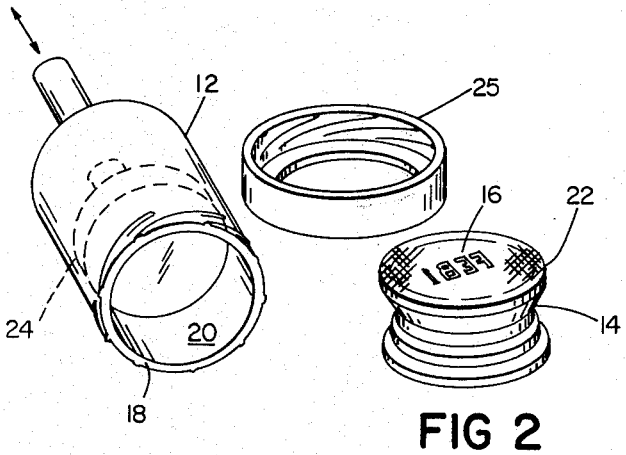

Other objects, features, and advantages of the present invention will appear from the following detailed description of a preferred embodiment thereof, taken together with the accompanying drawings wherein:

FIG. 1 is a schematic side view of the stencil printing apparatus according to the present invention; and FIG. 2 is an enlarged perspective view of the major elements of the stencil printing apparatus of FIG. 1.

Referring to the drawings, in general, the stencil printing apparatus of the invention includes a cylindrical rigid housing member, generally designated 12, an elastically compressible and deformable wall, generally designated 14, mounted on one end of housing member 12 and a flexible stencil screen, generally designated 16, mounted on the outer edge of wall 14.

More specifically, cylindrical rigid housing member 12 has side wall 18 which provides a chamber 20 for enclosing a quantity of printing fluid. The elastically compressible and deformable wall 14 is mounted on one end of housing member 12 and extends around the housing member and axially beyond its side wall 18 providing an extension of chamber 20. The outer edge 22 of deformable wall 14 is normally generally perpendicular to side wall 18 of chamber 20. Deformable wall 14 is frusto-conical with its smaller diameter end mounted on housing member 12 and the other end flaring outwardly therebeyond. A revised flare or a bellows configuration could be used as well.

The flexible stencil screen 16 has its outer peripheral edge sealingly mounted on outer edge 22 of the deformable wall 14. The flexible stencil screen extends across deformable wall 14 and is normally generally perpendicular to side wall 18 of chamber 20 in forming an end wall of chamber 20. Flexible stencil screen 16, including its outer peripheral edge, is deformable into continuous contact with an underlying surface when the deformable wall 14 is elastically compressed onto the underlying surface.

A piston 24 is mounted in chamber 20 adjacent the other end of housing member 12 for transmitting pressure to a printing fluid therewithin to extrude it through flexible stencil screen 16 onto the underlying surface when flexible stencil screen 16 is in contact with the underlying surface to be printed. A cap 25 secures the deformable wall 14 along with its flexible stencil screen 16 onto the housing member 12.

Referring to FIG. 1, housing member 12 is mounted on frame 26 which in turn is mounted on ink pressure cylinder 28 and print cylinder 30. Ink pressure cylinder 28 transmits pressure to piston 24 for extruding through stencil screen 16 the printing fluid contained in chamber 20. Print cylinder 30 is mounted on machine frame 32.

A controller 34 is provided for actuating the ink pressure cylinder 28 and the print cylinder 30. Controller 34 communicates with a bottle sensor 36, the print cylinder 30 and the ink pressure cylinder 28.

In operation, referring to FIG. 1, a plastic milk bottle B is moved into position to be printed and its presence is detected by bottle sensor 36. A signal is then transmitted to controller 34, which then transmits signals to actuate the ink pressure cylinder 28 and the print cylinder 30.

Print cylinder 30 then moves frame 26 into printing position, deforming both deformable wall 14 and the flexible stencil screen 16 so that the latter is in contact with the rounded shoulder of milk bottle B, as shown in dotted lines in FIG. 1. Controller 34 then transmits a signal to the ink pressure cylinder 28, which depresses piston 24. The pressure exerted by piston 24 extrudes the printing fluid contained in chamber 20 through the flexible stencil screen 16, and the image on the stencil screen is transferred onto the surface of the rounded milk bottle shoulder. Print cylinder 30 is then retracted and the printed bottle removed, in readiness for a succeeding printing cycle.

What is claimed is:

1. Stencil printing apparatus adapted for printing on a curved or irregular underlying surface, comprising:

a rigid housing member having side wall means providing a chamber for enclosing a quantity of printing fluid elastically compressible and deformable supporting wall means mounted on one end of said housing member and extending beyond said housing member side wall means providing an axial extension of said chamber, the outer edge of said supporting wall means being normally generally perpendicular to said side wall means of said chamber a flexible stencil screen having its outer peripheral edge sealingly mounted on said outer edge of said supporting wall means and extending thereacross normally generally perpendicular to said side wall means of said chamber to form an end wall of said chamber, said stencil screen including its outer pheriphal edge being deformable into continuous contact with said underlying surface and with said supporting wall means being elastically compressed thereby print cylinder means for moving said housing member and wall means to contact said stencil with a surface to be printed piston means mounted in said chamber adjacent the other end of said housing member for transmitting pressure to said printing fluid to extrude said printing fluid through said stencil screen when said stencil screen is in contact with said underlying surface to be printed, and common control means for actuating said print cylinder means and said piston means.

2. Stencil printing apparatus as claimed in claim 1, wherein said supporting wall means is frusto-conical with one end mounted on said housing member and flaring axially therebeyond.

* * * * *